US009162100B2

(12) United States Patent
Rasnake

(10) Patent No.: US 9,162,100 B2
(45) Date of Patent: Oct. 20, 2015

(54) ATHLETIC TRAINING DEVICE

(71) Applicant: Kyle Patrick Rasnake, Noblesville, IN (US)

(72) Inventor: Kyle Patrick Rasnake, Noblesville, IN (US)

( * ) Notice: Subject to any disclaimer, the term of this patent is extended or adjusted under 35 U.S.C. 154(b) by 54 days.

(21) Appl. No.: 13/856,515

(22) Filed: Apr. 4, 2013

(65) Prior Publication Data

US 2013/0303344 A1 Nov. 14, 2013

Related U.S. Application Data

(60) Provisional application No. 61/621,458, filed on Apr. 6, 2012.

(51) Int. Cl.

| | |
|---|---|
| ***A63B 21/02*** | (2006.01) |
| ***A63B 57/00*** | (2015.01) |
| ***A63B 69/00*** | (2006.01) |
| ***A63B 21/04*** | (2006.01) |
| ***A63B 21/055*** | (2006.01) |
| ***A63B 23/035*** | (2006.01) |
| ***A63B 23/12*** | (2006.01) |
| *A63B 21/00* | (2006.01) |

(52) U.S. Cl.

CPC ..... *A63B 21/02* (2013.01); *A63B 21/00043* (2013.01); *A63B 21/0442* (2013.01); *A63B 21/0552* (2013.01); *A63B 21/0557* (2013.01); *A63B 21/143* (2013.01); *A63B 21/1442* (2013.01); *A63B 21/1449* (2013.01); *A63B 23/03508* (2013.01); *A63B 23/03541* (2013.01); *A63B 23/1209* (2013.01); *A63B 69/0028* (2013.01); *A63B 69/0071* (2013.01); *A63B 21/00185* (2013.01); *A63B 69/0057* (2013.01); *A63B 2209/10* (2013.01)

(58) Field of Classification Search

CPC ..... A63B 21/0557; A63B 21/1449; A63B 21/00185; A63B 69/3608; A63B 21/02; A63B 23/1209; A63B 21/143; A63B 21/1442; A63B 69/0071; A63B 21/0552; A63B 23/03541; A63B 23/03508; A63B 21/0442; A63B 21/00043; A63B 69/0028; A63B 69/0057; A63B 2209/10; A63B 69/0059

USPC ..... 482/121–130, 139; 473/212–217, 422, 473/447, 450, 207

See application file for complete search history.

(56) References Cited

U.S. PATENT DOCUMENTS

| | | | | | |
|---|---|---|---|---|---|
| 866,495 | A | * | 9/1907 | Marks | 482/124 |
| 1,618,273 | A | * | 2/1927 | Davidson | 482/124 |
| 2,498,006 | A | * | 2/1950 | Ridill | 473/217 |
| 3,162,442 | A | * | 12/1964 | Karlik | 482/124 |
| 3,999,752 | A | * | 12/1976 | Kupperman et al. | 482/131 |
| 4,846,461 | A | * | 7/1989 | Robards et al. | 482/72 |
| 4,865,316 | A | * | 9/1989 | Yeaman | 482/126 |

(Continued)

FOREIGN PATENT DOCUMENTS

| | | | | | |
|---|---|---|---|---|---|
| GB | 2016285 | A | * | 9/1979 | A63B 21/02 |

*Primary Examiner* — Loan H Thanh
*Assistant Examiner* — Joshua Lee
(74) *Attorney, Agent, or Firm* — E. Victor Indiano; Indiano Law Group LLC

(57) ABSTRACT

An athletic training device capable of providing elastic resistance and associated methods of use for training a user to maintain optimal positioning of the user's hands during certain athletic activities. The device includes a wrist strap, a foot strap, and a thigh strap and an elastic tether of an adjustable length with the thigh strap configured to freely move along and about the elastic tether.

17 Claims, 20 Drawing Sheets

(56) References Cited

U.S. PATENT DOCUMENTS

| | | | | | |
|---|---|---|---|---|---|
| 5,203,754 | A * | 4/1993 | Maclean | 482/124 |
| 5,306,222 | A * | 4/1994 | Wilkinson | 482/124 |
| 5,308,305 | A * | 5/1994 | Romney | 482/124 |
| 5,372,565 | A * | 12/1994 | Burdenko | 482/124 |
| 5,545,113 | A * | 8/1996 | Bobich | 482/125 |
| 5,704,856 | A * | 1/1998 | Morse | 473/422 |
| 6,004,282 | A * | 12/1999 | Whitley | 602/5 |
| 6,283,877 | B1 * | 9/2001 | Cook | 473/450 |
| 6,361,517 | B1 * | 3/2002 | Slinger | 602/28 |
| 7,172,522 | B1 * | 2/2007 | Harvey | 473/450 |
| 7,314,437 | B2 * | 1/2008 | Frappier | 482/124 |
| 7,998,041 | B1 * | 8/2011 | Johnson | 482/124 |
| 2003/0092545 | A1 * | 5/2003 | Koscielny et al. | 482/124 |
| 2005/0261113 | A1 * | 11/2005 | Wilkinson | 482/124 |
| 2007/0135279 | A1 * | 6/2007 | Purdy et al. | 482/124 |
| 2009/0227384 | A1 * | 9/2009 | Reynolds | 473/207 |
| 2010/0041499 | A1 * | 2/2010 | Reynolds | 473/453 |
| 2011/0021329 | A1 * | 1/2011 | Dunne | 482/124 |
| 2012/0053026 | A1 * | 3/2012 | Kopp | 482/124 |
| 2012/0077652 | A1 * | 3/2012 | Georgiades | 482/124 |
| 2012/0202658 | A1 * | 8/2012 | Menefee, Sr. | 482/124 |

* cited by examiner

ATHLETIC TRAINING DEVICE

CROSS-REFERENCE TO RELATED APPLICATIONS

This application claims the benefit under 35 U.S.C. §119 (e) of Kyle Rasnake, U.S. Provisional Patent Application No. 61/621,458 that was filed on 6 Apr. 2012 which is incorporated herein by reference in its entirety.

I. TECHNICAL FIELD OF THE INVENTION

This invention relates generally to a training device, and more particularly, to a sports training aid that is particularly well adapted for helping to train persons desiring to become better basketball players, and also has utility in other training exercises such as training runners.

II. BACKGROUND

A major element of basketball is dribbling. Dribbling requires the use of one's hands to bounce the basketball in a controlled manner so that it bounces from the player's hand, to the floor, then back up to the player's hand. Generally, the player's hand while dribbling is open, with the palm facing down to the floor. A player must dribble while moving. A player taking more than two steps without dribbling may be called for a moving violation. Thus, coordination and control is vital to ensure that the player does not lose the basketball while dribbling and moving. Also, the player must dribble and be nimble enough to make it difficult for opposing players to steal or acquire the ball from the player.

There are numerous dribbling techniques a player can use to help prevent defenders from stealing the basketball. One such technique is for the player to powerfully dribble the ball low and close to his body. Preferably when dribbling low, the distance traveled by the basketball is the distance between the user's waist and the ground, or more desirably, between the user's knee and the ground. Additionally, by dribbling powerfully, the player exerts extra force to push the ball to the ground, resulting in the ball retuning more quickly to the player's palm, shortening the time that the ball is out of his hand and making it more difficult for a defender to steal the ball.

A good basketball player can dribble without actively thinking about it. Such a level of skill requires considerable time and effort to learn. Additionally, the muscles and muscle memory of a good basketball player are conditioned to dribble properly.

Similarly, other exercises such as running require proper form. Running with proper form can result in an increase in speed; a lower energy requirement, and less impact upon the runner's joints. By increasing resistance, runners can build up endurance as well as strength. By developing muscle memory, a runner can run faster.

III. SUMMARY OF THE INVENTION

This specification describes technologies relating to an athletic training device.

An object of the present invention is to provide a training device that is capable of encouraging a user to maintain and learn to maintain his hands in certain locations relative to his body when performing certain actions, such as dribbling a basketball or catching a ground ball in a baseball or softball game. Another object of the present invention is to provide a training aid that aids basketball coaches and players in learning how to dribble the basketball in a manner that is low to the ground, powerful and close to the body.

Still another object of this invention is provide a means to help a user build up endurance by enhancing the resistance experienced when engaged in certain activities such as running. Still another object of this invention is to help enhance the user's ability to train and teach his muscles proper movement ranges and to help maintain the user's appendages within certain distances of the user's body when performing certain athletic activities.

In accordance with the present invention, a device for athletic training is provided. The device comprises a first strap that is sized and configured to releaseably fasten around the wrist of a user. The first strap has a tethering portion. A second strap is sized and configured to releaseably fasten around the thigh of the user. The second strap has a slide connector. A third strap is sized and configured to releaseably fasten around the foot of the user. The third strap has a tethering portion. An elastic tether is provided that has a first end and a second end, with the first end having an enlarged plug and the second end having an enlarged plug. The first end of the elastic tether is connected to the tethering portion of the first strap, and the second end of the elastic tether is connected to the tethering portion of the third strap.

In a preferred embodiment, the device includes a grommet that is disposed within the tethering portion of one of the first or third straps. A slide connector attaches the second strap to the elastic tether such that the second strap can move along an axis of elongation of the elastic tether.

In accordance with another aspect of the present invention, a basketball training device is provided that comprises an elastic tether that longitudinally extends through a grommet of a tethering portion of a wrist strap, wherein the tethering portion is disposed adjacent to the center of the wrist strap. A thigh strap is slideably attached to the elastic tether such that the thigh strap can freely move about and along the longitudinal axis of the elastic tether. A foot strap is provided that has a tethering portion that possesses a grommet through which the elastic tether longitudinally extends. Each end of the elastic tether is enlarged such that the end of the elastic tether associated with the wrist strap cannot pass through the grommet of the tethering portion of the wrist strap, and the end of the elastic tether associated with the foot strap cannot pass through the grommet of the tethering portion of the foot strap.

One feature of the present invention is that it includes a plurality of adjustment points. These adjustment points have the advantage of enabling the device to be sized more appropriately for the user. This feature has several spin-off advantages. One advantage is that the adjustability of the device enables a user to buy the device for a child, and utilize the same training device for the child as the child grows and changes sizes. As a corollary, the user can purchase a single device, and use the same device for a plurality of different users of different sizes, without being forced to buy multiple devices. As a further corollary, the adjustability of the device reduces inventory headaches, since the distributor, marketer or multi-device purchaser (such as a gym or training facility), can buy a plurality of single size devices, rather than being forced to buy a plurality of different size devices. This not only simplifies inventory considerations, but also makes inventory issues less complicated and cumbersome.

The details of one or more embodiments of the subject matter described in this specification are set forth in the accompanying drawings and the description below. Other features, aspects, and advantages of the subject matter will become apparent from the description, the drawings, and the claims.

IV. BRIEF DESCRIPTION OF THE DRAWINGS

Like reference numbers and designations in the various drawings indicate like elements.

V. DETAILED DESCRIPTION

Figure 1:
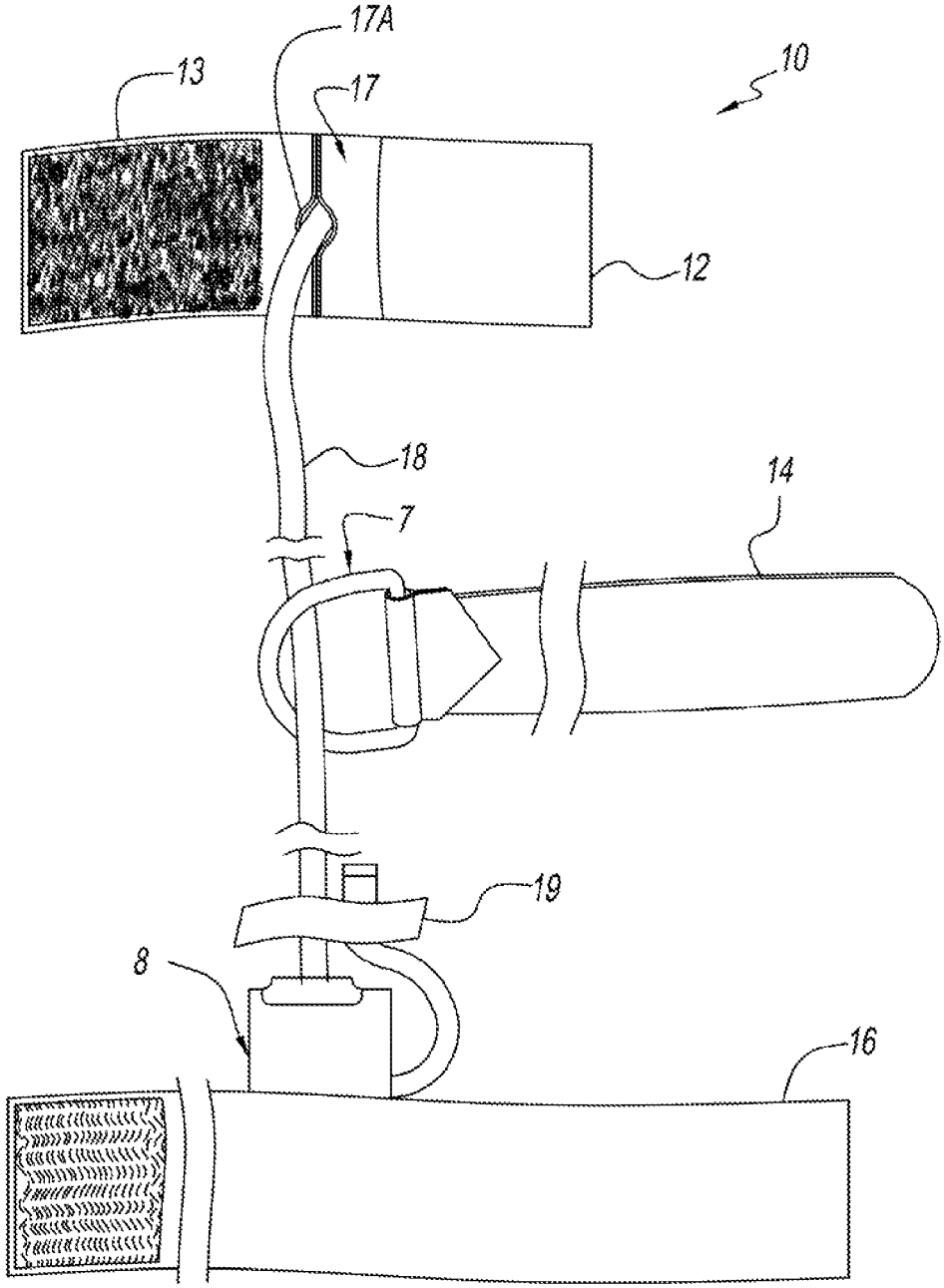
FIG. 1 is a perspective view of an example of the described training aid in accordance with an implementation of the present invention.

Before the present implementations, methods of use, and systems are disclosed and described, it is to be understood that this invention is not limited to specific methods, specific components, implementations, or to particular compositions, and as such may, of course, vary. It is also to be understood that the terminology used herein is for the purpose of describing particular implementations only and is not intended to be limiting.

As used in the specification and the claims, the singular forms "a," "an" and "the" include plural references unless the context clearly dictates otherwise. Ranges may be expressed in ways including from "about" one particular value, and/or to "about" another particular value. When such a range is expressed, another implementation may include from the one particular value and/or to the other particular value. Similarly, when values are expressed as approximations, for example by use of the antecedent "about," it will be understood that the particular value forms another implementation. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not. Similarly, "typical" or "typically" means that the subsequently described event or circumstance often though may not occur, and that the description includes instances where said event or circumstance occurs and instances where it does not.

In some embodiments, the training aid is a device that consists of one or more elastic members such as elastic tubes. Examples of other elastic members include elastic straps, elastic cords, elastic bands, and the like. Each elastic tube has a first end and a second end. One or more elastic members are attached to one or more attachment devices. In some implementations, the attachment devices are adjustable attachment devices such as Velcro® straps. A Velcro strap is a strap having a hook-and-loop type material, such as Velcro® coupled to a surface adjacent the first end of the strap and also a surface adjacent to the second end of the strap, allowing selectively adjustable joining to form a loop. Examples of other adjustable attachment devices include buckled straps, adjustable plastic straps cable tie straps, and the like. The adjustable attachment devices can be sized and configured to better engage various bodily locations of a user. For example, an adjustable attachment device can be sized and configured for engaging the wrist of the user.

In some implementations, the adjustable attachment devices can have one or more mounts, each mount for securing an end of an elastic member to the adjustable attachment device. Further, in some implementations the adjustable attachment devices can include a loop through which one or more elastic members can pass. The one or more elastic members can pass through the loop such that a user can vary the distance between the adjustable attachment devices.

In some implementations, the training aid includes one or more adjustable attachment devices having a slide member. A slide member can enable an adjustable attachment device to be secured to an elastic member such that the point of attachment of the adjustable attachment device can slide along the elastic member.

FIG. 1 is a perspective view of an example of a training aid 10 constructed according to a preferred embodiment of the present invention. In this implementation, the training aid 10 comprises a first strap 12, a second strap 14, a third strap 16, and an elastic member 18. The elastic member 18 has a first or proximal end 41 coupled to the first strap 12, and a second or distal end 43 coupled to the third strap 16. The straps can be composed of any flexible material suitable for attachment to the human body and for use in the athletic environment in which the training aid 10 is to be used. For example, the straps can be composed of leather, rubber, nylon, silk, heavy cloth, flexible urethane, polychloroprene, and the like.

In this illustrated implementation, the first strap 12 is sized to comfortably fit around a wrist when closed and can be termed a wrist strap. The second strap 14 is sized to comfortably fit around a thigh when closed and can be termed a leg engaging strap. The third strap 16 is sized to comfortably fit around a shoed foot when closed and can be termed a foot engaging strap. However, some implementations utilize one or more elastic rings to replace one or more of the straps. For example, a ring made of polychloroprene and sized to slide over a hand when stretched and comfortably fit around a wrist when in a relax state can be used in place of the first strap 12.

Each strap has a fastener for fastening the strap in a closed, endless loop configuration. For example, the first strap 12 can be fastened around the wrist of a user. In some implementations, the fastening of some of the straps is accomplished through the straps having a first surface 13 having an adhesive or contact adhesive surface or a mechanical fastener and the second surface 15 having a mating adhesive or mating contact adhesive surface or second component of the mechanical fastener. For example, the first surface 13 as well as the second surface 15 can be covered with hook-and-loop fasteners such as Velcro® enabling the strap to fasten upon itself. Those familiar with the operation of a hook-and-loop fastener will recognize that typically one comprises a "hook member" as one adhesive, and the "loop member" is the other adhesive, as the hook-and-loop fastener fasten together when engaged to each other.

The fastening surfaces 13 and 15 vary in length depending upon the respective strap. For example, the fastening surfaces 13 and 15 can each have an associated length of 8 inches for the third strap 16 while the corresponding surfaces for the first strap 12 would have a correspondingly shorter length.

In some embodiments, the first strap 12 has an engaging portion 17. The engaging portion 17 can also be termed a tether engaging portion 17 or tethering portion 17. The dimensions of the first strap 12 may vary, depending upon the expected wrist size of the user. In some implementations, the first strap 12 has a width of about 1 to 2 inches and a length of approximately 8 to 14 inches. However, the width and length of the first strap 12 can vary based upon the expected circumference of the wrist of the expected user.

The engaging portion 17 attaches the elastic member 18 to the first strap 12. In some implementations, the engaging portion 17 is disposed adjacent to the center of the first strap 12. In such implementations, the engaging portion 17 can be composed of a smaller length of the material composing the straps with both ends of the engaging portion 17 permanently attached to the first strap 12.

Further, the engaging portion 17 of such an embodiment has an aperture that the elastic member 18 extends through. In some embodiments, the aperture 17A is reinforced with a grommet that is disposed within the aperture 17A of the engaging portion 17, for receiving a distal end of the elastic member 18. The diameter of the grommet can vary based upon the diameter of the elastic member 18. In some embodiments the grommet results in the engaging portion 17, forming a triangle from the first strap 12 with the engaging portion 17 thus forming a triangle having a height in the range of between about 0.75 and about 1.25 inches. This is to say that the engaging portion 17 forms a triangular grommet holder, having its apex disposed at the strap, and the grommet hole opening downward, so that the elastic member 18 may extend in a direction generally perpendicular to the primary direction of extent of the first strap 12.

Additionally, such implementations can have a fitting secured to the elastic member 18 or alternately, the end of the elastic member 18 can be enlarged, such as done by a knot in the elastic member 18, to maintain the attachment between the elastic member 18 and the first strap 12 by preventing the end of the elastic member 18 from passing through the aperture of the engaging portion 17.

However, in some implementations, the engaging portion 17 is disposed adjacent to an edge of the first strap 12. Alternately, in some embodiments, the elastic member 18 has a clip type fastener on one or both of its ends. Such implementations facilitate the quick and easy replacement of the elastic member 18 by enabling the elastic member 18 to be clipped or attached to the first strap 12. Alternately, some implementations make use of a clip attached to the first strap 12 that clips onto the elastic member 18.

The second strap 14 can have a length in the range of 19-24 inches, and a width in the range of 0.75 to 1.75 inches. However, the width and length of the second strap 14 can vary based upon the circumference of the thigh of the expected user. In some implementations, the second strap 14 has a slide connector 7 with which the second strap 14 is movably attached to the elastic member 18. In some implementations, the slide member 7 is composed of a D-ring, a "D" shaped ring of metal, plastic, or other suitable material. The second strap 14, through the use of the slide connector 7, is attached to the elastic member 18 such that the second strap 14 can be freely moved along and about the longitudinal extent of the elastic member 18. Alternately, some implementations make use of two elastic members. In such implementations, the first elastic member is attached on one end to the third strap 16 and attached on the other end to the second strap 14. One end of the second elastic member is attached to the second strap 14 and a second end of the elastic member is attached to the first strap 12.

The third strap 16 has an elastic member attachment point 8. The third strap 16 can have a length in the range of about 9-15 inches, and a width in the range of about 0.75 to 1.75 inches. However, the width and length of the third strap 16 can vary based upon the expected circumference of the foot of the user.

In some implementations, the elastic member attachment point 8 constitutes a strip of material similar to, or the same as, the material composing strap 16, which is sewn to form a loop that is attached near the middle of strap 16. The attachment point 8 can also be termed a tethering point 8. In such implementations, the elastic member attachment point 8 further contains an aperture 8A having a diameter large enough to permit the free movement of the elastic member 18 through the aperture.

In some embodiments, a grommet is disposed within attachment point 8, for receiving a distal end of the elastic member 18. The width of the grommet varies based on the diameter of the elastic member 18. In some embodiments, the grommet has a width of between 0.75 and 1.25 inches causing the engaging portion 17 to form a triangle from the third strap 16. The attachment point 8 thus forms a triangle of a height in the range of between 0.75 and about 1.25 inches.

This is to say that the material forming the attachment point 8 forms a triangular grommet holder, having its apex disposed at the third strap 16, and the grommet hole 8A opening upwardly, so that the elastic member 18 may extend in a direction generally perpendicular to the primary direction of extent of the third strap 16.

In some embodiments, adjustment of the functional length of the elastic member 18 is accomplished through the use of a clip 19. The clip 19 includes a first jaw member 45, a second jaw member 47, a hinge 49 for hingedly coupling the first and second jaw members 45, 47 and inter-engageable clasp members 53, 55. The clasp members are releasably engageable to hold the jaws 45, 47 in a closed position wherein the inwardly facing surfaces 59 can engage the elastic member 18 to fixedly position the elastic member.

However, other implementations make use of a buckle or the like to shorten the functional length of the elastic member 18. As shown in the drawings, the clip 19 shortens the functional length of the elastic member 18 by firmly attaching to two sections of the elastic member 18. In contrast, other embodiments make use of an adjustable clip that attach only to one portion of the elastic member 18. In such implementations, the clip is designed so that when fastened, it cannot pass through the aperture of the attachment point 8. In still other implementations, the elastic member 18 is knotted such that the elastic member 18 is fixable at the desired length.

In some implementations, the elastic member 18 is composed of a length of elastic tubing. For example, in some implementations the elastic member 18 is composed of latex surgical tubing. The length of the elastic member 18 chosen for the device can be based upon the user's body. For example, the length of the elastic member 18 can be approximately equal to the distance between the user's feet to his chest when the user is standing upright. The elastic member 18 can also be termed a tether 18 or an elastic tether 18.

In some other variations, the elastic member 18 is a solid elastic cord. In still other implementations, the elastic member 18 is a strip or sheet of elastic material. In still other implementations, the elastic member 18 can have different colored sections with the different colored sections having different degrees of elasticity.

For example, the elastic member 18 could be composed of a red section with weaker resistive elasticity and a black section with greater resistive elasticity. In this example, such an elastic member 18 could be used to provide a visual indicator to a coach of how much force a user was exerting when using the training device.

In some implementations, the elastic member 18 can have an enlarged plug. The enlarged plug can ensure that the end of the elastic member 18 is maintained within the attachment portion 17 of the first strap 12. Likewise, the elastic member 18 can have a second enlarged plug such that the other end of the elastic member 18 is prevented from passing through the aperture of the elastic member attachment point 8.

Figure 2:
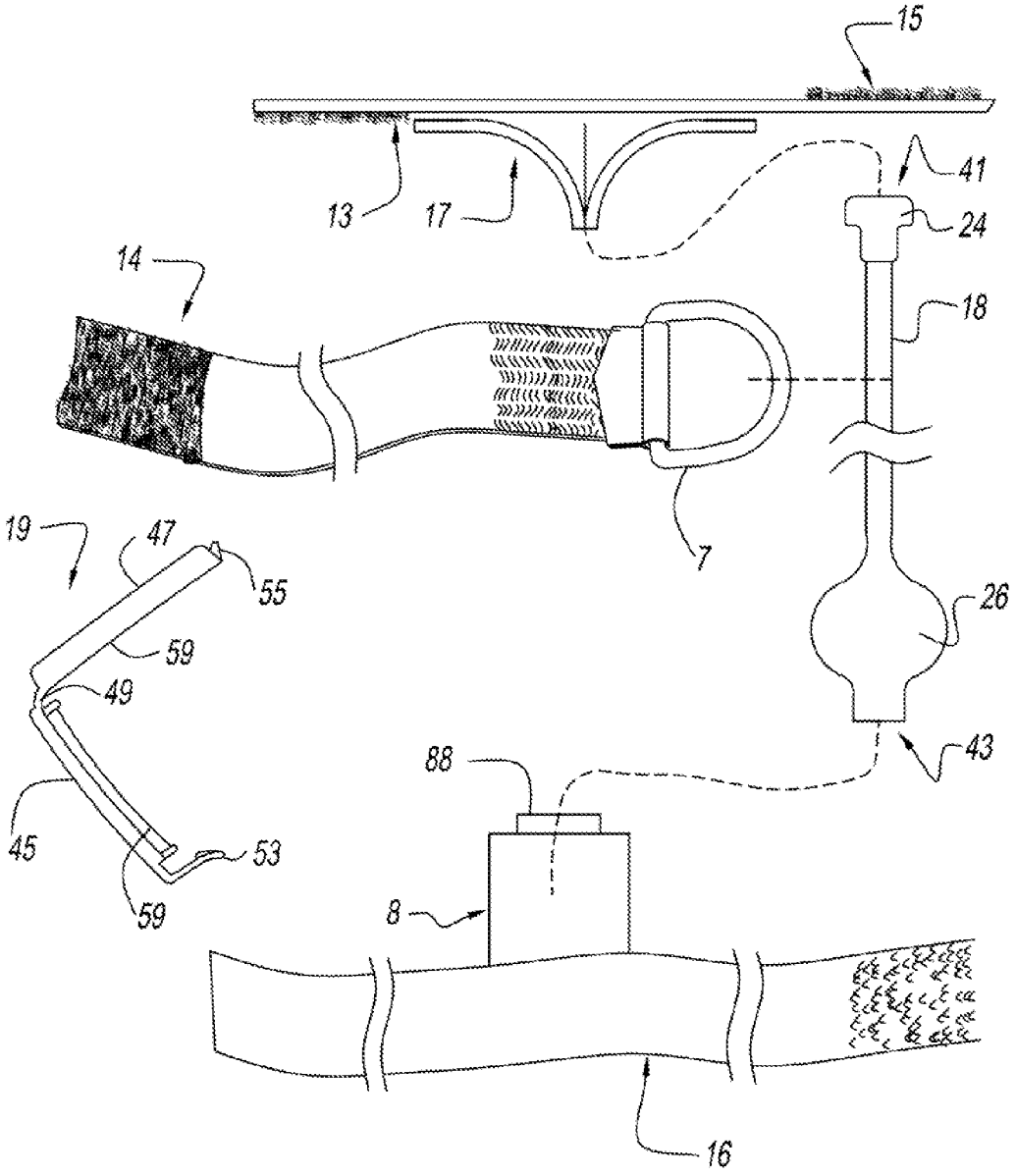
FIG. 2 is an exploded view depicting a selection of components of an implementation of the described training aid in accordance with an implementation of the present invention.

FIG. 2 is an exploded view depicting a selection of components of an implementation of the training aid of the present invention. FIG. 2 presents the elastic member 18 as having enlarged plugs 26 and 24 that are useful for helping to maintain the attachment of the elastic member 18 to the first strap 12 and the third strap 16.

Figure 3:
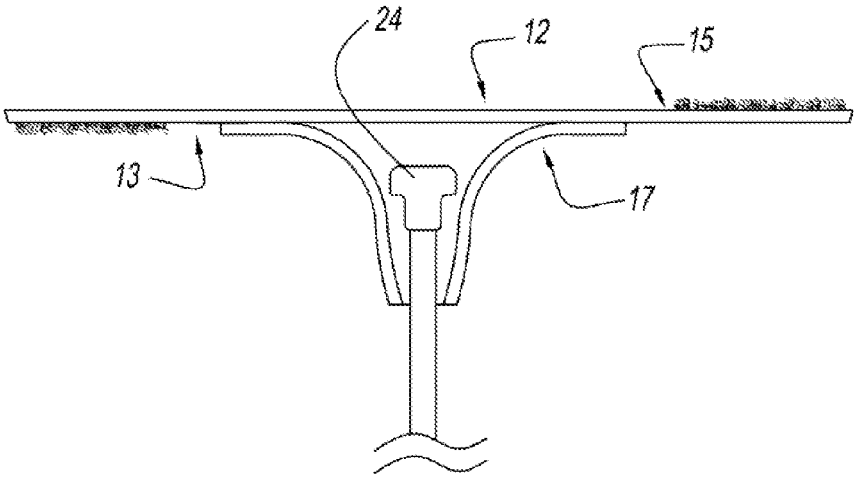
FIG. 3 is a side, sectional view of the first strap and elastic member of an implementation of the present invention.

FIG. 3 is a side, sectional view of the first strap 12 and elastic member 18 of an implementation of the present invention. In FIG. 3, the elastic member 18 is drawn to have a plug 24 that secures the elastic member 18 to the engaging portion 17 of the first strap 12.

Figure 4:
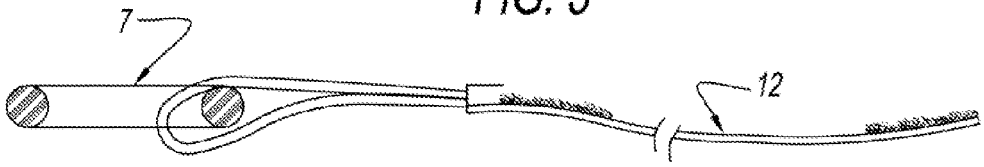
FIG. 4 is a side, sectional view of the second strap of an implementation of the present invention

FIG. 4 is a side, sectional view of the second strap 14 of an implementation of the present invention. In the figure, the slide connector 7 can also be seen.

Figure 5:
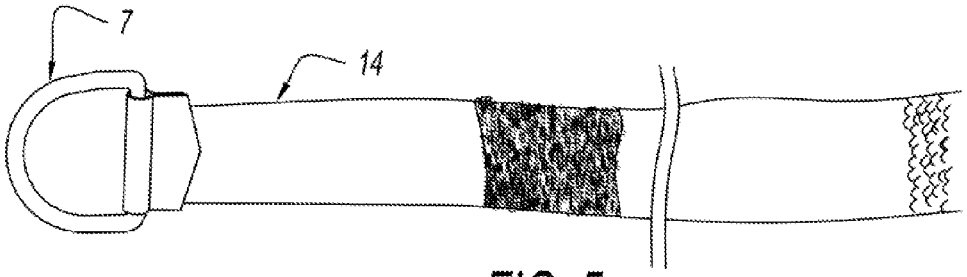
FIG. 5 is a top view of the second strap of an implementation of the present invention.

FIG. 5 is a top view of the second strap 14 of an implementation of the present invention. As drawn, the slide connector 7 is a "D" ring. However, a ring, a FIG. 8 or S connector, or the like could also be used.

Figure 6:
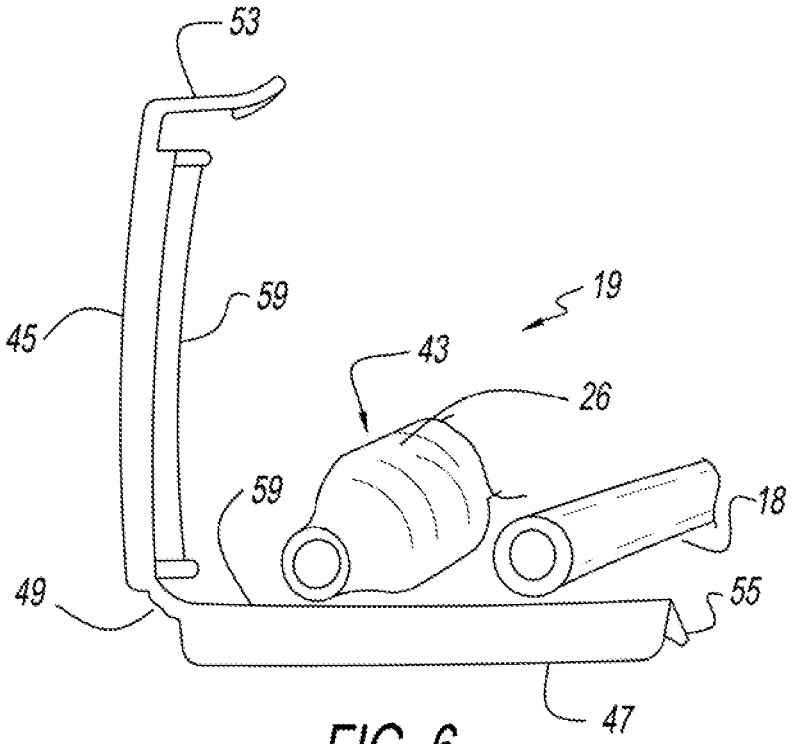
FIG. 6 is a top view of a clip in an open position used in an implementation of the present invention.

FIG. 6 is a top view of a clip 19 in an open position used in an implementation of the present invention. It will be noted that the clip includes a first leg, a second leg, and a hinge for hingedly coupling the first leg to the second leg. A clasp mechanism is provided for maintaining the first and second legs in an engaged or closed configuration. FIG. 6 also depicts a cut-away view of the elastic member 18 having a plug or enlarged end 24.

Figure 7:
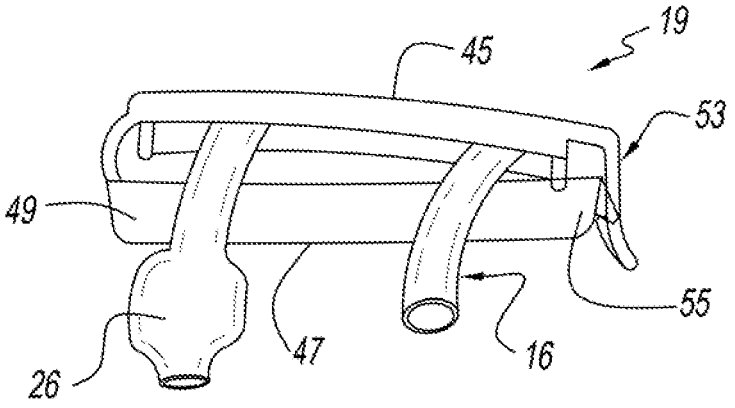
FIG. 7 is a side view of a clip in a closed position, securing the elastic member, used in an implementation of the present invention.

FIG. 7 is a top view of a clip 19 in a closed position, securing the elastic member 18, used in an implementation of the present invention. FIG. 7 also depicts a cut-away view of the elastic member 18 having a plug or enlarged end 24.

Figure 8:
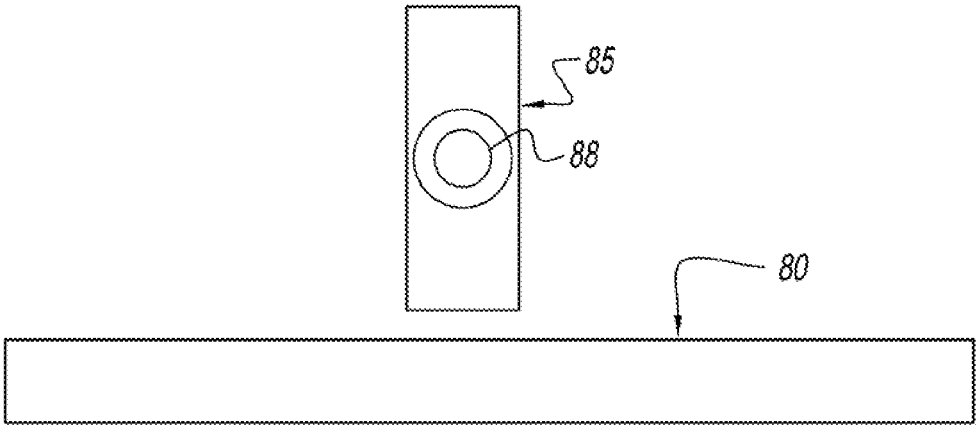
FIG. 8 is an exploded view of a general example of a strap and a tether attachment point and the associated grommet that can be used in an implementation of the present invention.

FIG. 8 is an exploded view of a general example of a strap 80 and a tether attachment point 85 and the associated grommet 88 that can be used in an implementation of the present invention.

Figure 9:
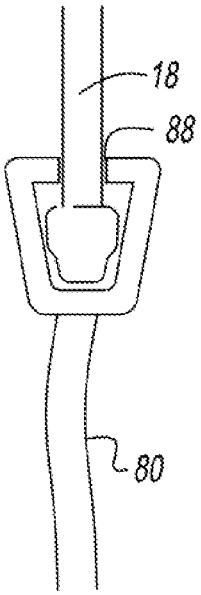
FIG. 9 is a sectional view showing a depiction of the elastic member and a corresponding tether attachment point of a strap.

FIG. 9 is a sectional view showing a depiction of the elastic member 18 and a corresponding tether attachment point 88 of a strap. In this depiction, the elastic member 18 has an enlarged or plugged end firmly fixing the distal end of the elastic member 18.

Figure 10:
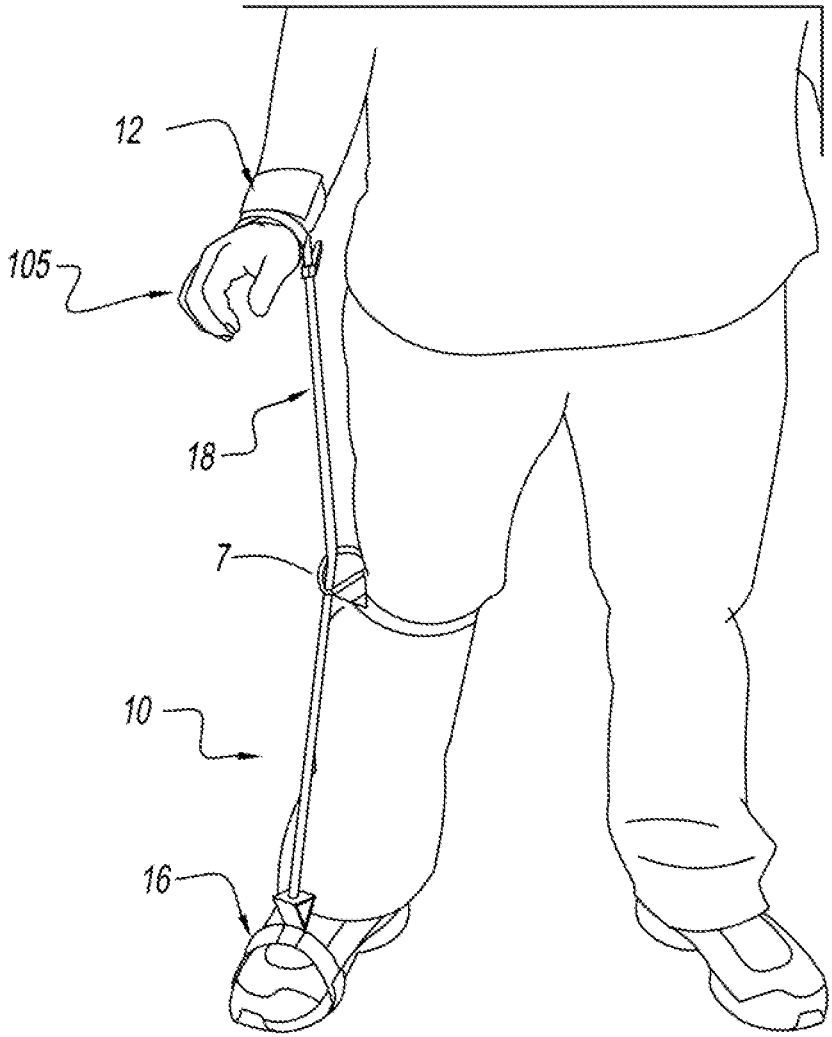
FIG. 10 is a view of an implementation of the described invention worn by a user (without basketball) showing the device properly adjusted and the elastic member in a relaxed position.

FIG. 10 is a view of an embodiment of the present invention strapped to a user who is posed in a basketball dribbling position, albeit without a basketball. FIG. 10 shows the device 10 properly adjusted and the elastic member 18 in the relaxed position. In this depiction, the third strap 16 (foot strap) is wrapped around the user's foot, so that a portion of the foot strap is disposed under the sole of the user's foot. It will be noted that the second strap 14 (leg engaging strap) is wrapped around the user's leg, positioned approximately near the knee. The first strap 12 (wrist strap) is wrapped around the user's wrist.

With the elastic member 18 still relaxed but fully extended, the user's hand is in a rest position 105 that is about or near the user's waist or hip. The rest position 105 represents the position that should approximately be in the vicinity of the apex of a bounce cycle of a basketball when the user is bouncing the basketball correctly, and maintaining it low. Note that a user's preferred rest position 105 can vary from user to user and accommodation of such variance can be accomplished through using the clip 19 to vary the rest length of the elastic member 18.

Figure 11:
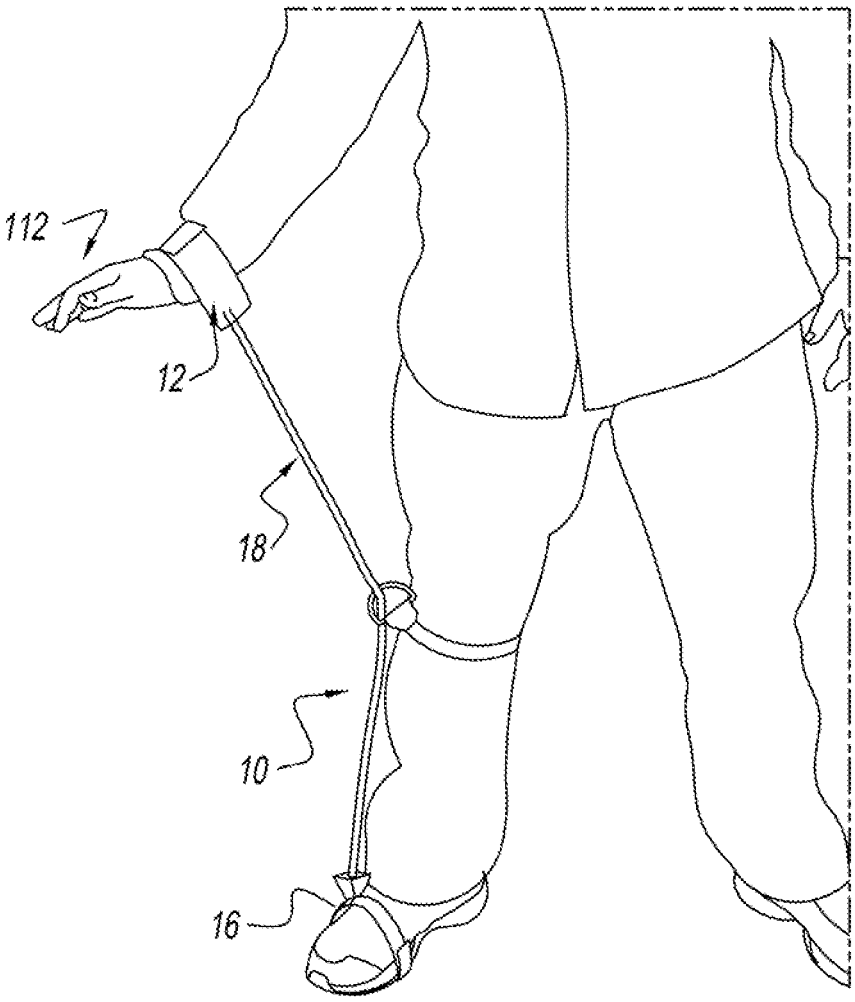
FIG. 11 is a view of an implementation of the described invention worn by a user (without basketball) showing device in a configuration where the user has moved his hand to a position that is about at the natural top rest length of the tether device, but has moved outwardly to point of the end of the comfort area in which the user can move while wearing the invention.

FIG. 11 is a view of an implementation of the described invention worn by a user (without basketball) showing device in a configuration where the user has moved his hand to a position 115 that is about at the natural top rest length of the tether device, but has moved outwardly for practical extent and maximum comfort area. FIG. 11 serves to illustrate that the device not only helps to keep the user's hand low, but also helps to keep the user's hand close to his body 112, so that the user learns to better dribble the basketball at a position close to his body 112. As discussed above, when the basketball is being dribbled close to the user's body 112, there is less chance for a defender to steal the basketball from the user.

As used in this application, "maximum comfort positioning" will generally designate a relative position of the user's hand, knee and foot, wherein the user has stretched the tether 18 to a point where the tether 18 exerts a noticeable resistance (maximum comfortable strength length) upon further movement in the direction causing an elongation of the tether 18. Because of the elasticity of the tether 18, it will be appreciated that even at the "maximum comfortable strength length", there still exists the ability of the user to stretch the tether 18 even further.

However, maximum comfortable stretched strength length will be used in this application to denote that position that generally designates the furthest extent to which the user can extend the tether 18 during a normal exercise, without placing undue and uncomfortable stress on either the user or the elastic member 18. It will also be appreciated that the maximum comfortable stretch length (or position) will vary based on the strength of the user. As such, a particular user's maximum comfortable stretch position may expand as the user grows stronger.

By restricting inside movement of the hand while dribbling, the device can help to teach the user to keep the basketball in a position wherein the dribbling hand (here shown as the right hand) can exert good power and control on the basketball. In this regard, it will be appreciated that if the user were able to move his hand further to the left (as shown in FIG. 11A), the likelihood of the user losing control of the basketball increases.

Figure 11A:
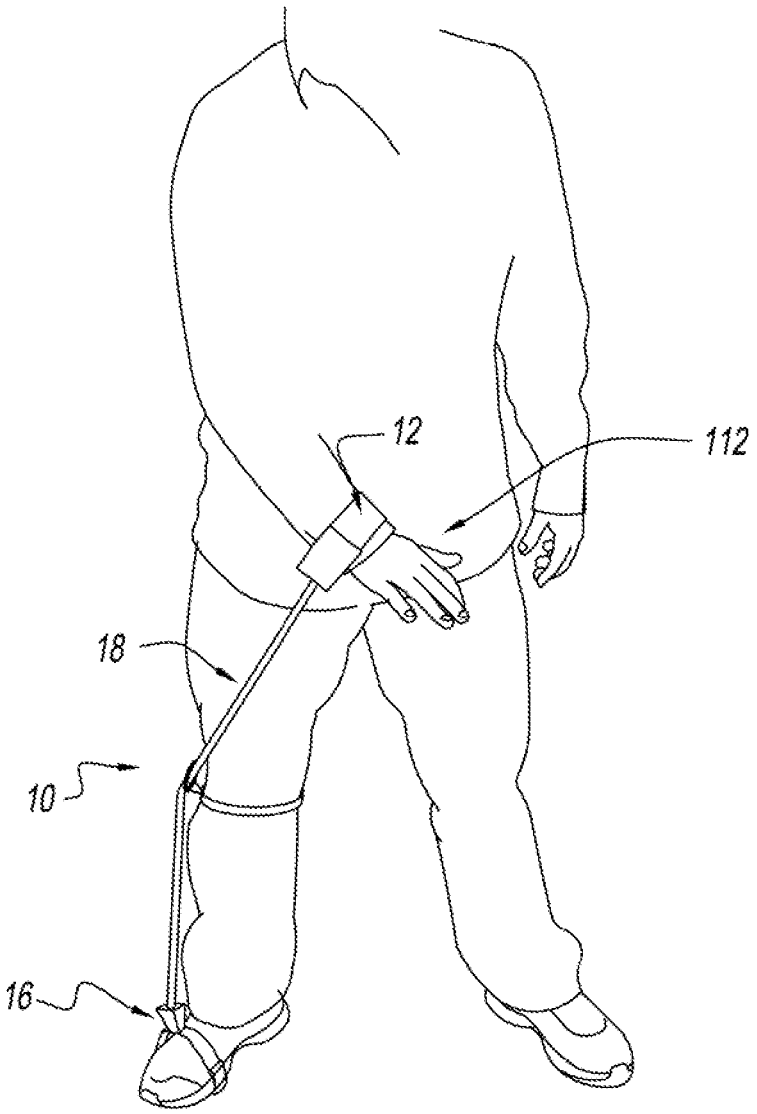
FIG. 11A is a view of an implementation of the described invention worn by a user (without basketball) showing the device properly adjusted and the elastic member under tension with the user's arm positioned in a non-preferred position for dribbling near and in front of the user's body.

Also, the user's dribbling would become more clumsy if the user were to move his hand far to the left, such as by trying to dribble the basketball to the left of his left foot as shown in FIG. 11A. This clumsy dribbling would reduce the user's ability to defend the basketball against a defender, and would cause the user to have less control over the basketball. As such, by limiting the ability of the user to move the basketball across the body 112, the device helps to teach the user to dribble the basketball in a manner that maintains the basketball in a position where the user can assert the most control over the basketball, and can best defend it against other players.

Figure 12:
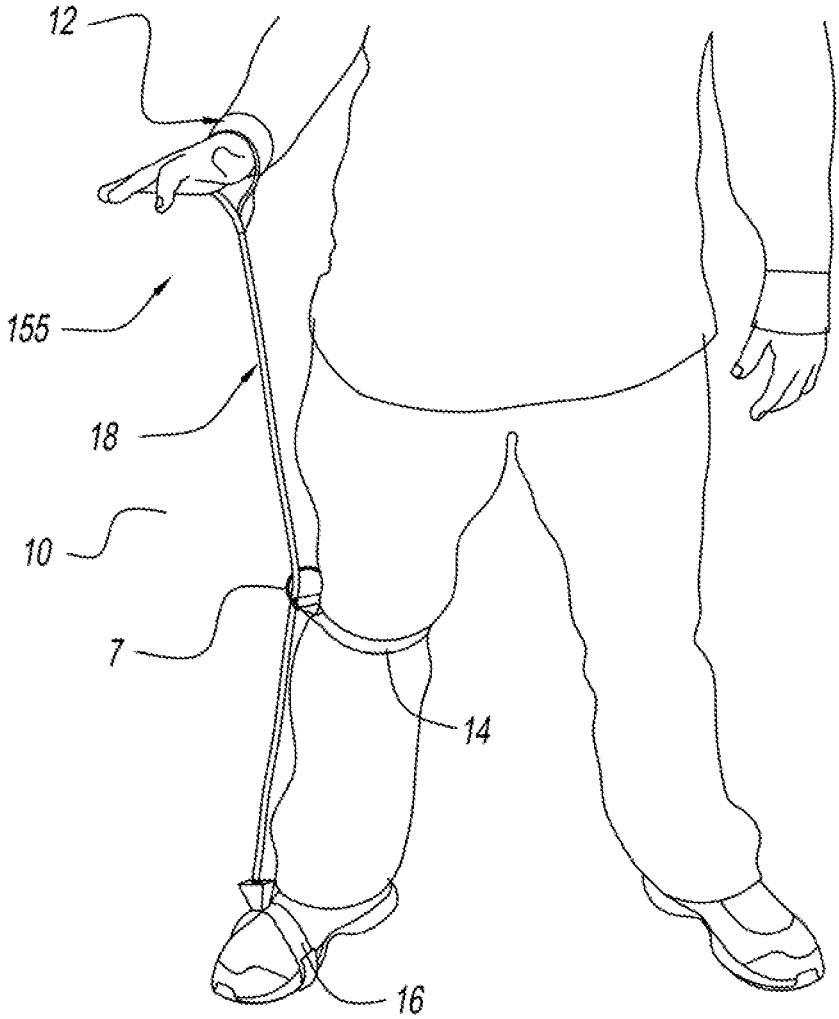
FIG. 12 is a view of an implementation of the described invention worn by a user (without basketball) showing the device properly adjusted and the elastic member under tension with the user's arm positioned at a maximum desirable distance from the ground near the user's feet.

FIG. 12 is a view of an implementation of the described invention worn by a user (without basketball) showing the device properly adjusted and the elastic member under tension with the user's arm positioned at a maximum desirable distance from the ground near the user's feet. In this figure, the user is shown in its maximum comfortable stretched strength upward position where the user has raised his hand to a point that represents the maximum point to which the user can raise it comfortably, while attached to the elastic member 18.

As shown in FIG. 12, this maximum stretch length positioning of the tether 18 limits the upward movement of the user's hand to maintain the user's hand within a desired zone 155 for dribbling a basketball. That is to say that the user is free to move his hand within a desirable zone of area for dribbling a basketball but movement outside of the zone is retarded through increasing resistance provided by the tether 18. As shown, the upper comfort limit of the desirable zone of dribbling is about at waist height for the user.

Figure 13:
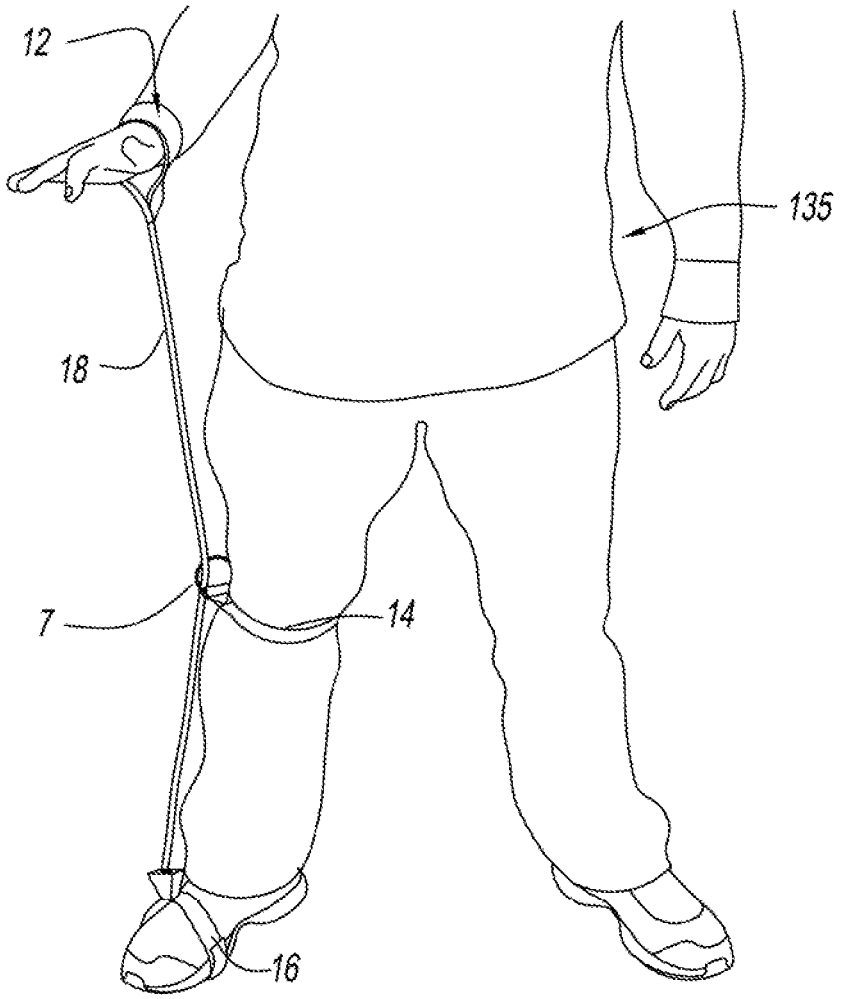
FIG. 13 shows an implementation of the device in its rest position, when the tether is extended to its maximum practical length.
Figure 13A:
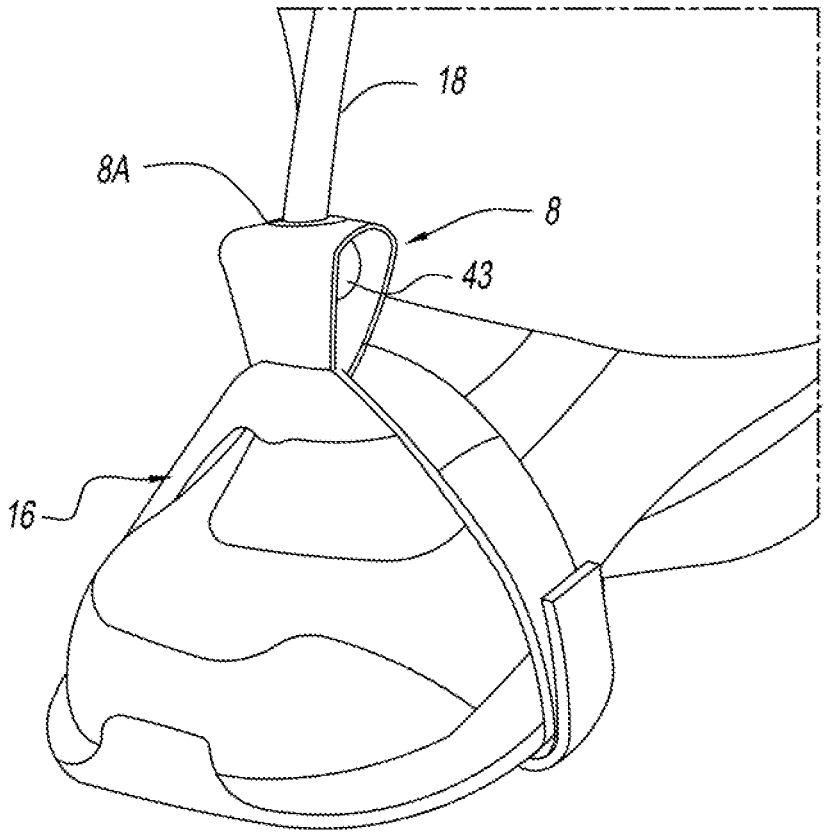
FIG. 13A is an enlarged view portraying the third strap, attached around a user's foot, and the elastic member attached to the third strap without adjustment of the elastic member.

FIG. 13 shows the device in its rest position, when the tether 18 is extended to its maximum length. As shown in FIG. 13A, there is no "tail" of the tether 18 emerging from the tether-engaging portion 8. As such, the plug 26 of the stretchable elastic tether 18 is fully contained within the tether engaging portion 8 of the foot strap. When in this position, the normal rest length of the tether 18 enables the tether 18 to be placed at approximately the waist 135 of the user shown in the drawings.

Figure 14:
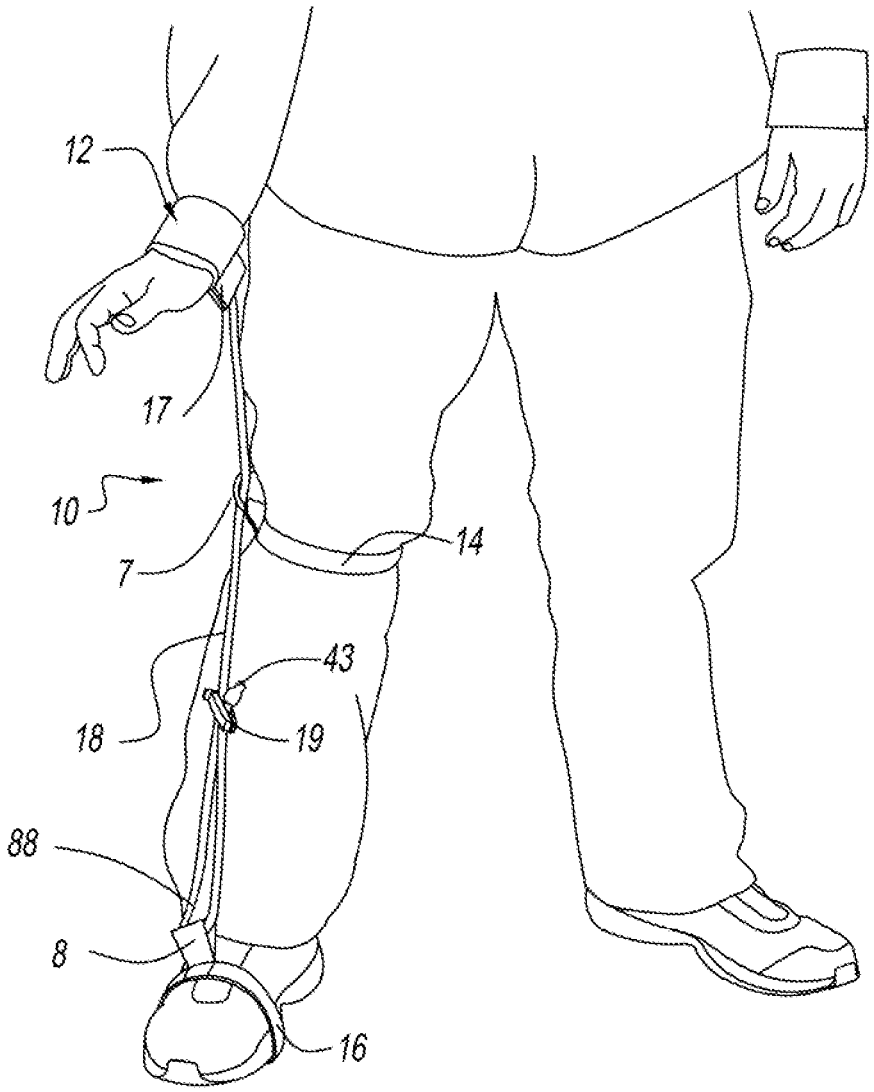
FIG. 14 is a view of an implementation of the described invention worn by a user (without basketball) showing the elastic member in a relaxed state.

FIG. 14 shows an implementation of the device wherein the length of the tether 18 has been shortened to provide a smaller useable tether length. Such shortening of the tether 18 may be used either to teach a normal sized person to maintain the basketball at even a lower dribble bounce level; or alternately, adjust the length of the tether 18 so that it better fits a shorter individual, such as a child.

Figure 14A:
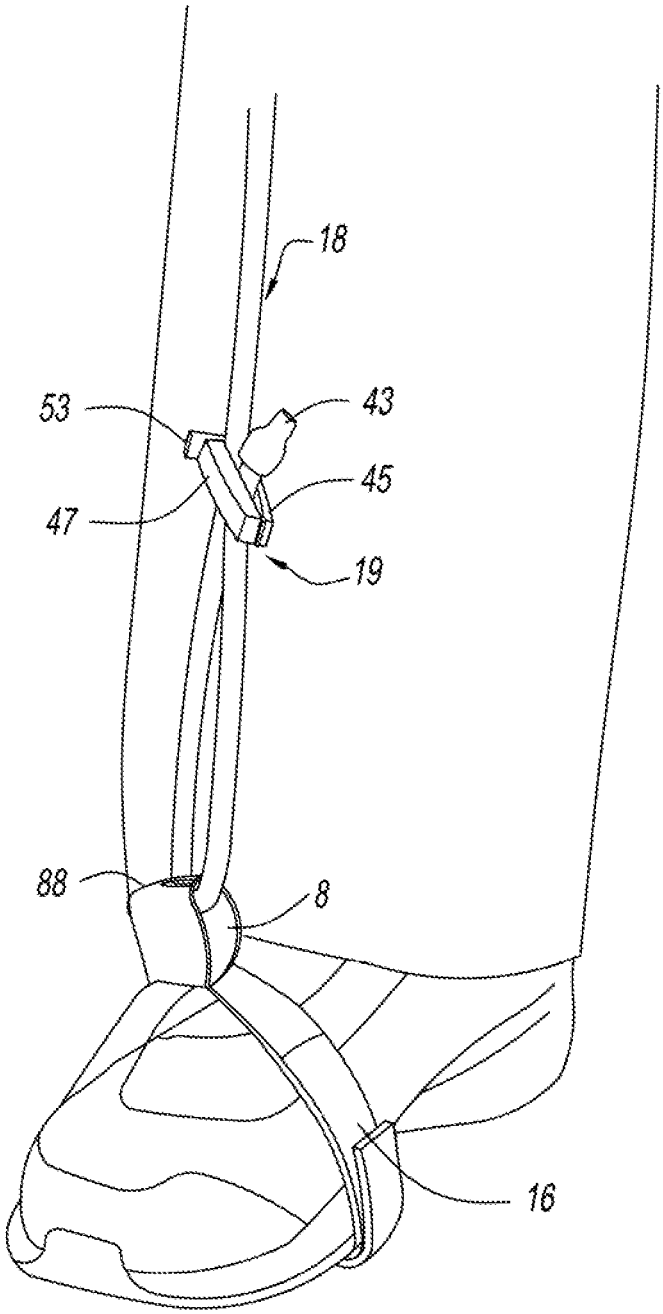
FIG. 14A is an enlarged view portraying the third strap, attached around a user's foot, and the elastic members attached to the third strap and the elastic member shortened through the use of the clip.

As best shown in FIG. 14A, the distal end of the tether 18 extends through the tether engaging grommet 88, through the side of the tether engaging portion 8, and is then passed in a parallel relation to the remainder of the tether 18. Near the distal end of the tether 18, the distal end of the tether 18 is coupled by a clip 19 to the downwardly extending portion of the tether. This shortens the overall usable length of the tether 18 and helps to maintain the tail end of the tether 18 in an appropriate position, and keeps it from "flopping around" and possibly getting under the user's foot, and thereby interfering with his foot. Additionally, by placing the tether 18 in this position, the desired length of the tether 18 is maintained.

In some implementations, the interior tether engaging surface of the clip 19 includes first and second parallel ridges that extend along the length of the tether engaging surface. These ridges concentrate the force applied onto the tether 18 and help to grip onto the tube of the tether member 18, to help prevent the tether member 18 from slipping, or moving laterally within the space between the jaws of the clip 19 when the two jaws of the clip 19 are coupled together by the clamp that is disposed at the distal ends of the clamp.

Figure 15:
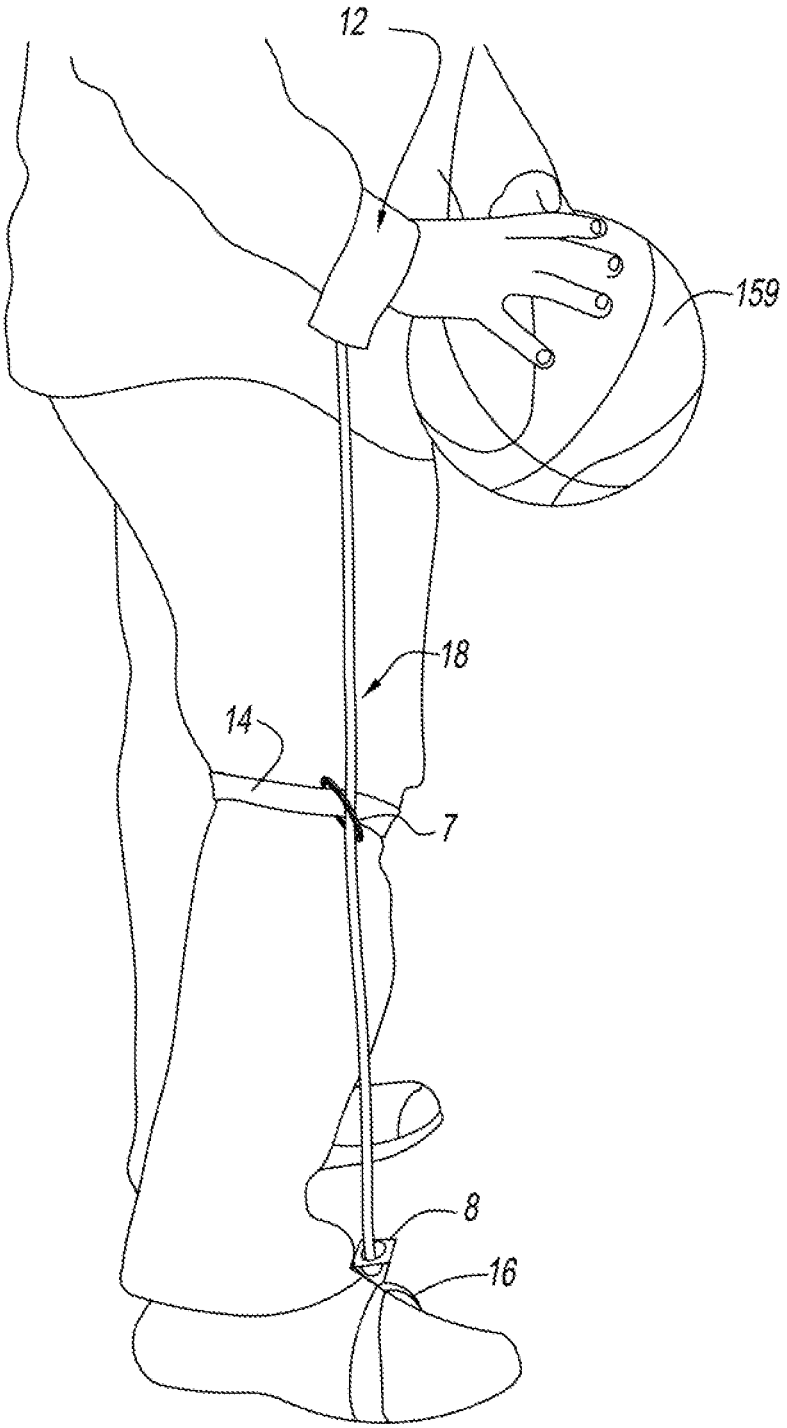
FIG. 15 is a side view of an implementation of the described invention worn by a user (with basketball) showing the elastic member under tension and serving to encourage the user to hold the basketball within a preferred distance from the floor.

FIG. 15 is a side view of an implementation of the described invention worn by a user (with basketball) showing the elastic member 18 under moderate to slight tension and serving to encourage the user to hold the basketball 159 within a preferred distance from the floor. FIG. 15 shows the training aid 10 helping to assist the user to keep the ball 155 at a natural rest position. The user is shown holding a basketball 155 to give the reviewer a better idea and conception of what the device looks like when being used to train a basketball player.

Figure 16:
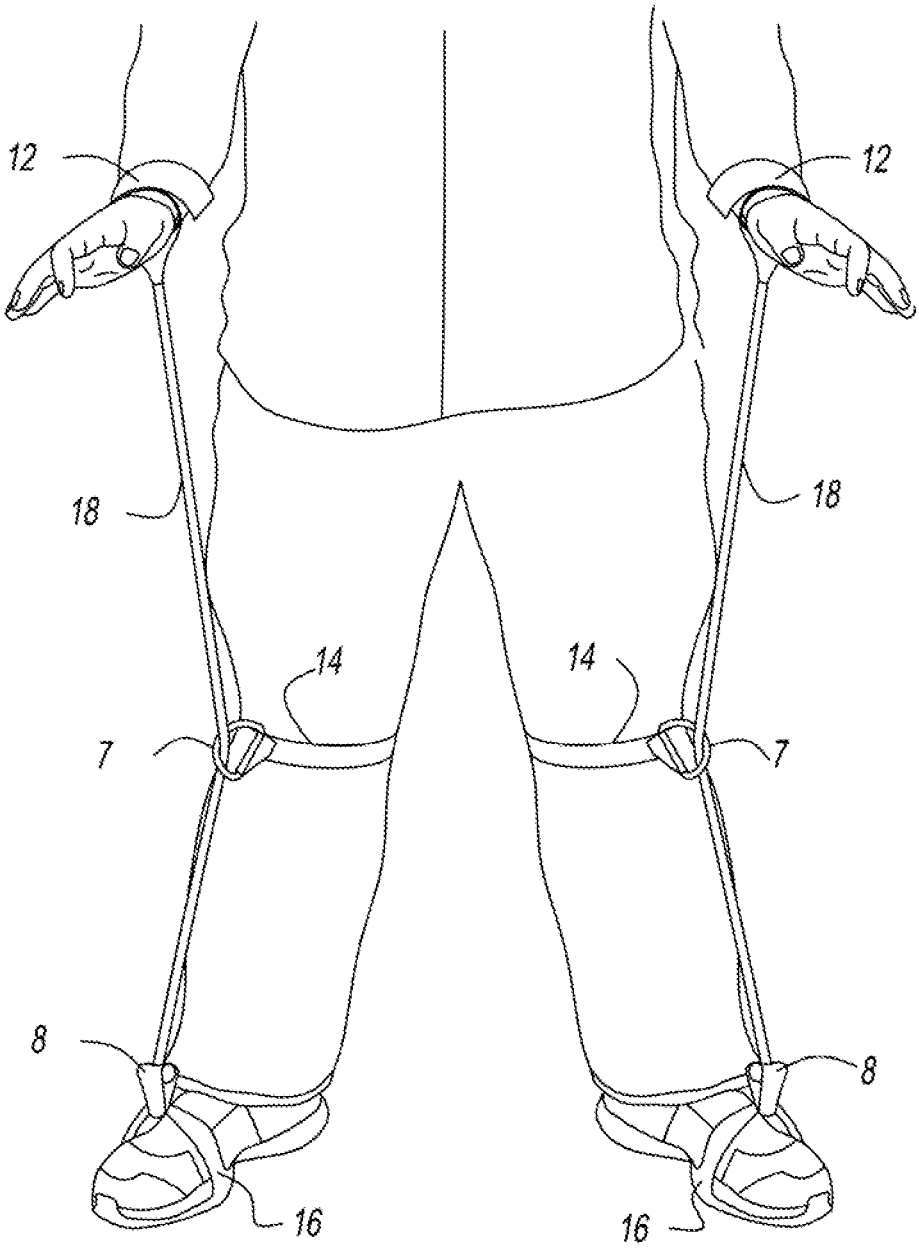
FIG. 16 shows two implementations of the described invention being employed simultaneously, one on the left hand and left leg and the second on the right hand and right leg.

FIG. 16 shows two implementations 165 and 168 of the described invention being employed simultaneously, one on the left hand and left leg and the second on the right hand and right leg. The two training 165 and 168 devices are especially useful when trying to train basketball players to dribble with both hands, as each device's tether helps to control its respective hand, keeping the hands at the proper positions and orientations to maximize effective dribbling. That is, the devices 165 and 168 serve to help ensure that dribbling is done low to the ground, and is done with power, along with the dribbling being done close to the user's body 155 so that the user can better protect himself against defenders.

Figure 17:
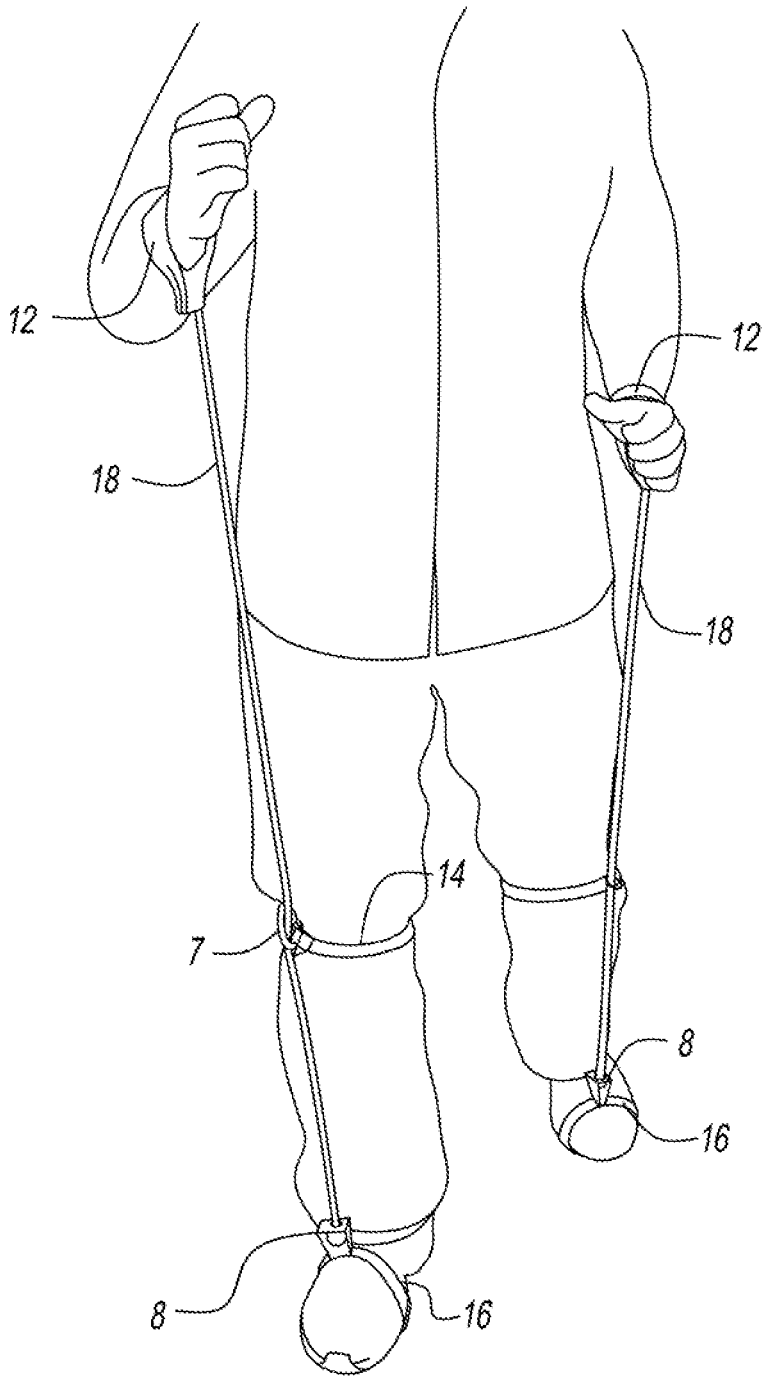
FIG. 17 is a frontal view of a user in a running pose illustrating one method of how an implementation of the described invention can be employed in running exercises.

FIG. 17 is a frontal view of a user in a running pose illustrating one method of employing the present invention in running exercises. When running, the resistance provided by the tether devices serve to help maintain the user in a desired running posture and motion. Further, the devices can serve to increase the amount of energy the user has to exert when running since the user is required to exert effort to overcome the resistance induced by the tethers 18.

Figure 18:
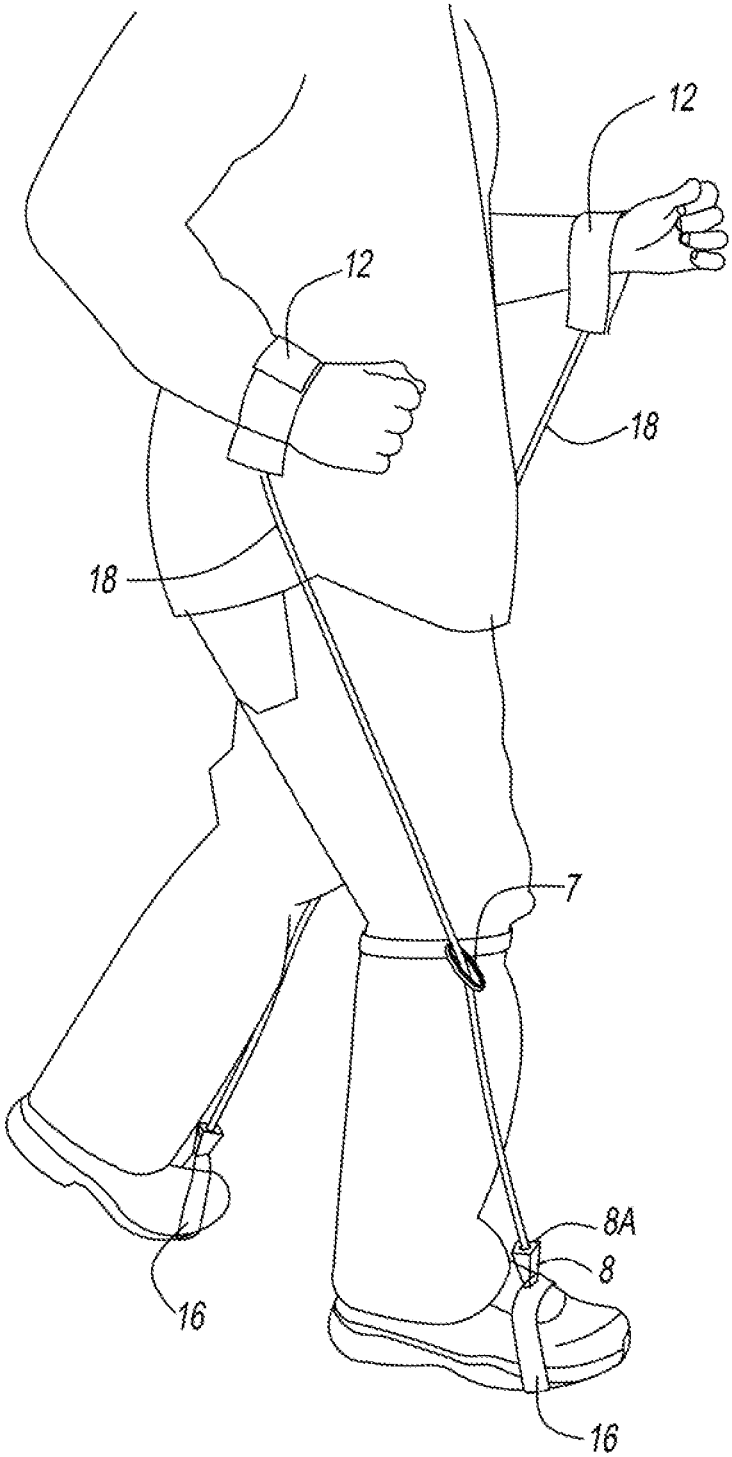
FIG. 18 is a side view of a user in a running pose illustrating one method of how an implementation of the described invention can be employed in running exercises.

FIG. 18 is a side view of a user in a running pose illustrating one method of employing the present invention in running exercises.

Figure 19:
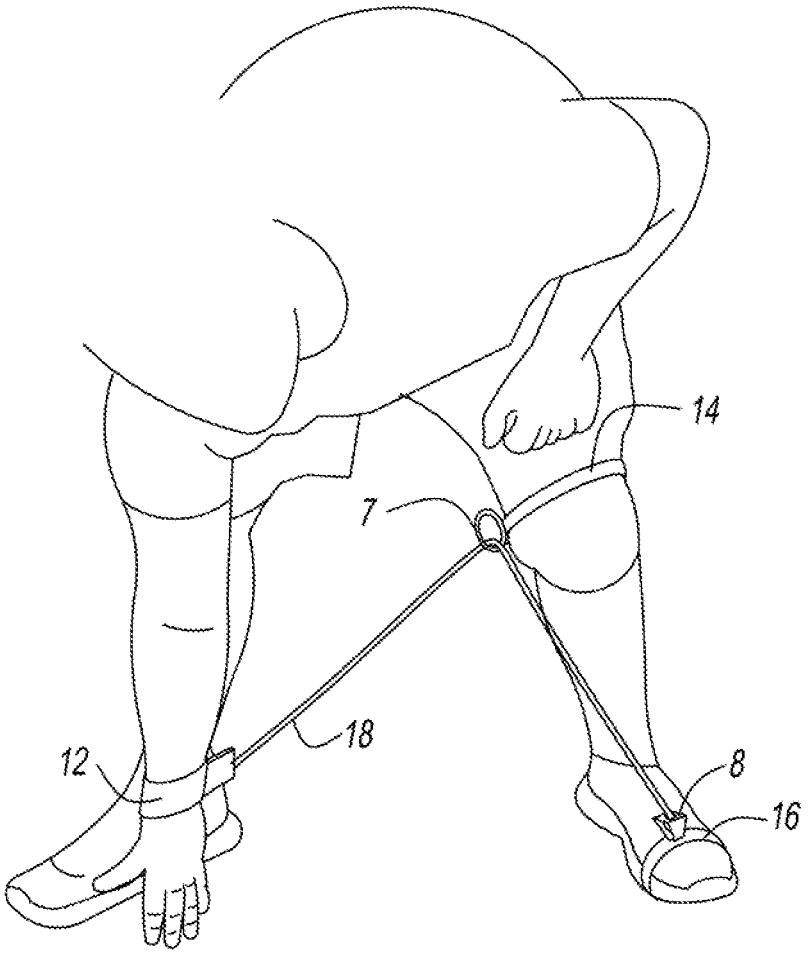
FIG. 19 is a frontal view of a user in a baseball training exercise pose illustrating the present invention being employed as a baseball training aid.
Figure 20:
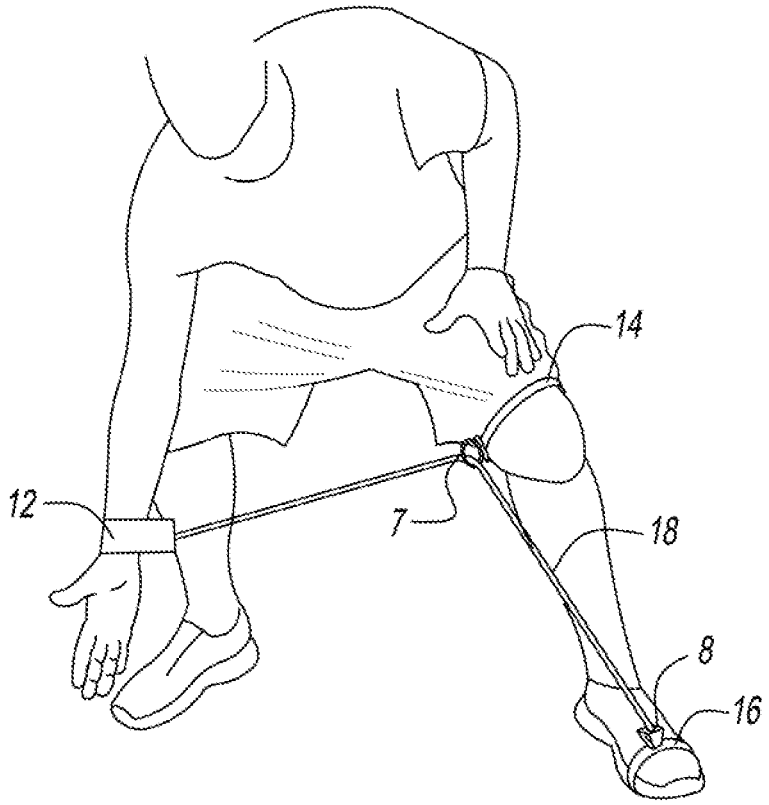
FIG. 20 is a frontal view of a user in a baseball training exercise pose illustrating the present invention being employed as a baseball training aid.
Figure 21:
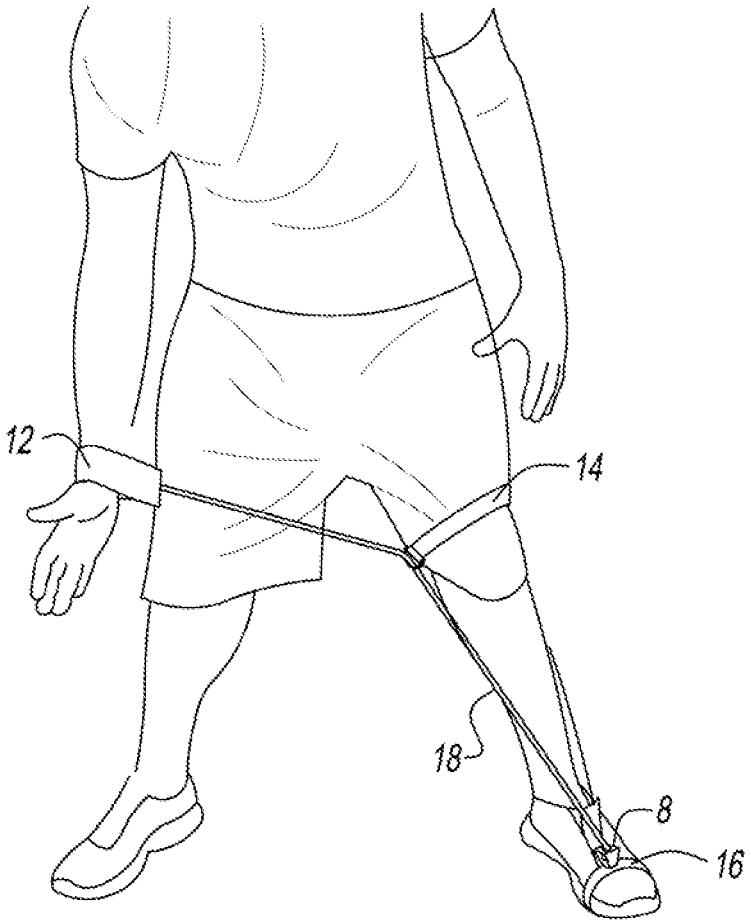
FIG. 21 is a frontal view of a user in an upright baseball training exercise pose illustrating the present invention being employed as a baseball training aid.

FIGS. 19-21 show the training aid as being used to help train a user to improve his baseball skills. In particular, users who are learning the game of baseball often have trouble learning to place the edge or a portion of their mitt 190 on the ground when stopping or catching ground balls. Often, a new baseball player will repeatedly hold their mitt 190 a few inches off the ground. As such, new baseball players often experience the situation where ground balls roll under the player's mitt 190 and evade the player's attempt to catch the balls.

FIG. 19 shows the user in a ground ball receiving position, wherein his hand (and hence his mitt if playing) would be close to a ground engaging position. FIG. 20 shows the generally furthest, comfortable position that the user can move the mitt laterally and to the right, and off the ground. The device's restive restriction of range of motion helps the user to learn the preferable range within which to catch a ground ball. Also, by keeping the mitt generally centered in front of the user's body, it teaches the user how to position his body in, or close to the path of the ball, which increases the user's probability of successfully fielding the ball, or at least stopping it.

FIG. 21 is similar to FIG. 20, except that it shows the user moving his hand to the generally maximum comfortable elevated and laterally right position.

While this specification contains many specific implementation details, these should not be construed as limitations on the scope of any inventions or of what may be claimed, but rather as descriptions of features specific to particular embodiments of particular inventions. Many other variations and modifications and other uses will become apparent to those skilled in the art.

Various sizes, shapes, and materials detailed in this specification are not necessary to the invention. Thus, the present invention should not be limited by the specific disclosure herein but only by the appended claims. Certain features that are described in this specification in the context of separate embodiments can also be implemented in combination in a single embodiment.

Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a sub-combination.

The separation of various device components in the embodiments described above should not be understood as requiring such separation in all embodiments, and it should be understood that the described training aid's components can be integrated together in a single device or packaged into multiple sub components, such that the multiple sub components work together serving as the training device.

Thus, particular embodiments of the subject matter have been described. Other embodiments are within the scope of the following claims. The actions depicted in the accompanying figures do not necessarily require the particular positions shown to achieve desirable results.

What is claimed is:

1. A device for athletic training, said device comprising: a single elastic tether having a first end having an enlarged portion, a second end having an enlarged portion and a middle portion extending between the first end and the second end, a first strap having a tethering portion, the first strap being sized and configured to releasably fasten around a wrist of a user, the tethering portion of the first strap being coupled to the first end of the single elastic tether;

a second strap having a slide connector configured to permit the middle portion of the single elastic tether to slide along the slide connector, the second strap being sized and configured to releasably fasten around a thigh of the user;

a third strap having a tethering portion, the third strap being sized and configured to releasably fasten around a foot of the user a tethering portion of the third strap being coupled to the second end of the single elastic tether;

wherein with the elastic tether still relaxed but fully extended, the user's hand is in a rest position that is about or near the user's waist.

2. The device of claim 1 wherein a grommet is disposed within the tethering portion of the first strap, the enlarged portion of the first end comprising an enlarged plug, and the enlarged portion of the second end comprises an enlarged plug.

3. The device of claim 1 wherein a grommet is disposed within the tethering portion of the third strap.

4. The device of claim 1 wherein the slide connector attaches the second strap to the elastic tether such that the second strap can move along an axis of elongation of the elastic tether.

5. The device of claim 1 wherein the first strap, the second strap, and the third strap each has a respective first portion covered with a hook member of a hook-and-loop type fastener and the first strap, the second strap, and the third strap each has a respective second portion covered with a loop member of a hook-and-loop type fastener.

6. The device of claim 1 wherein the elastic tether has a first section and a second section, wherein the first section has an elasticity having a first value, and the second section has an elasticity having a second value different from the first value.

7. The device of claim 6 wherein the first section has a first color and the second section has a second color differing from the first color.

8. The device of claim 1 further comprising a clip for permitting a user to adjust an effective length of the tether.

9. The device of claim 8 wherein the slide connector is a D connector.

10. The device of claim 2 wherein the enlarged plug of the first end of the elastic tether is larger than the diameter of an opening of the grommet.

11. A basketball training device comprising:

a single elastic tether having a first end having an enlarged portion, a second end having an enlarged portion and a middle portion extending between the first end and the second end, the first end of the elastic tether extending longitudinally through a grommet of a tethering portion of a wrist strap wherein the tethering portion is disposed adjacent to the center of the wrist strap;

a thigh strap including a slide coupler for slidably coupling to the single elastic tether such that the thigh strap and the single elastic tether can freely move with respect to each other about and along the longitudinal axis of the single elastic tether;

a foot strap having a tethering portion possessing a grommet through which the second end of the single elastic tether extends longitudinally through;

wherein each of the first and second ends of the single elastic tether is enlarged such that the first end of the elastic tether cannot pass through the grommet of the tethering portion of the wrist strap and the second end of the single elastic tether associated with the foot strap cannot pass through the grommet of the tethering portion of the foot strap; and wherein with the elastic tether still relaxed but fully extended, the users hand is in a rest position that is about or near the user's waist.

12. The device of claim 11 wherein the wrist strap, the thigh strap, and the foot strap each has a respective first portion covered with a hook member of a hook-and-loop type fastening system and the wrist strap, the thigh strap, and the foot strap each has a respective second portion covered with a loop member of a hook-and-loop type fastening system.

13. The device of claim 11 wherein the elastic tether has a first section having a first color and having a first elasticity and a second section having a second color and having a second elasticity, wherein the first elasticity differs from the second elasticity, and the first color differs from the second color.

14. The device of claim 11 further comprising a clip including a first jaw, a second jaw, a hinge for hingedly coupling the first jaw to the second jaw, and a clamp for maintaining the first and second jaws in a closed position.

15. The device of claim 11 wherein the elastic tether is composed of an elastic tubing member, and wherein the slide coupler comprises a ring through which the elastic tether can slidably move.

16. The device of claim 11 wherein the wrist strap, the thigh strap, and the foot strap are each composed of flexible urethane.

17. A device for athletic training, said device consisting essentially of:

a single elastic tether having a first end having an enlarged portion, a second end having an enlarged portion and a middle portion extending between the first end and second end, the first end having an enlarged portion and the second end having an enlarged portion, a first strap having a tethering portion, the first strap being sized and configured to releasably fasten around a wrist of a user;

a second strap coupled to a slide connector for pivotal movement with respect to the slide connector, the second strap being sized and configured to releasably fasten around a thigh of the user;

the slide connector configured for slidably receiving the second strap for permitting the slide connector as a whole to pivot about the single elastic tether and permitting the single elastic tether to slidably move in the slide connector;

a third strap having a tethering portion, the third strap being sized and configured to releasably fasten around a foot of the user;

wherein the first end of the single elastic tether is connected to the tethering portion of the first strap;

wherein the second end of the single elastic tether is connected to the tethering portion of the third strap; and wherein with the elastic tether still relaxed but fully extended, the user's hand is in a rest position that is about or near the user's waist.

* * * * *